US011401057B2

(12) United States Patent
Kiessner

(10) Patent No.: US 11,401,057 B2
(45) Date of Patent: Aug. 2, 2022

(54) METHODS FOR PACKAGING A PACKAGED PRODUCT AND ONE OR MORE UNPACKAGED PRODUCTS FOR SHIPMENT

(71) Applicant: PACKSIZE LLC, Salt Lake City, UT (US)

(72) Inventor: Hanko Kiessner, Salt Lake City, UT (US)

(73) Assignee: PACKSIZE LLC, Salt Lake City, UT (US)

( * ) Notice: Subject to any disclaimer, the term of this patent is extended or adjusted under 35 U.S.C. 154(b) by 37 days.

(21) Appl. No.: 16/647,192

(22) PCT Filed: Aug. 31, 2018

(86) PCT No.: PCT/US2018/049228

§ 371 (c)(1),
(2) Date: Mar. 13, 2020

(87) PCT Pub. No.: WO2019/060129

PCT Pub. Date: Mar. 28, 2019

(65) Prior Publication Data

US 2021/0122506 A1 Apr. 29, 2021

Related U.S. Application Data

(60) Provisional application No. 62/560,514, filed on Sep. 19, 2017.

(51) Int. Cl.
*B65B 5/06* (2006.01)
*B65B 7/20* (2006.01)
(Continued)

(52) U.S. Cl.
CPC ..... *B65B 5/06* (2013.01); *B65B 7/20* (2013.01); *B65B 17/02* (2013.01); *B65B 51/02* (2013.01);
(Continued)

(58) Field of Classification Search
CPC .. B65B 5/06; B65B 7/20; B65B 17/02; B65B 43/41; B65B 51/02; B65B 51/06;
(Continued)

(56) References Cited

U.S. PATENT DOCUMENTS 2,973,129 A 2/1961 Stone et al.
3,130,891 A 4/1964 Lange-Wiche
(Continued)

FOREIGN PATENT DOCUMENTS

DE 29519505 U1 * 3/1996 ..... B65D 5/5286
FR 2811303 1/2002
(Continued)

OTHER PUBLICATIONS

International Search Report dated Jan. 25, 2019, PCT/US2018/049228.

*Primary Examiner* — Stephen F. Gerrity

(57) ABSTRACT

The present disclosure relates to methods for preparing a packaged product and one or more unpackaged products for shipping. The methods may include providing a shipping container generally sized to accommodate the unpackaged product(s). The shipping container has a plurality of walls and a bottom that define an interior of the shipping container, and each of the walls has an edge that cooperate to define an open side of the shipping container. The methods may also include inserting the unpackaged product(s) into the shipping container, and attaching the shipping container to the packaged product such that a wall of the packaged product covers the open side of the shipping container.

17 Claims, 9 Drawing Sheets

(51) Int. Cl.

| | |
|---|---|
| ***B65B 17/02*** | (2006.01) |
| ***B65B 51/02*** | (2006.01) |
| ***B65D 5/20*** | (2006.01) |
| ***B65D 21/02*** | (2006.01) |
| ***B65D 77/04*** | (2006.01) |
| ***B65D 5/42*** | (2006.01) |

(52) U.S. Cl.
CPC ..... *B65D 5/2052* (2013.01); *B65D 5/427* (2013.01); *B65D 21/0205* (2013.01); *B65D 21/0209* (2013.01); *B65D 77/042* (2013.01); *B65B 2210/04* (2013.01); *B65B 2220/14* (2013.01); *B65B 2220/16* (2013.01); *B65D 2577/043* (2013.01)

(58) Field of Classification Search
CPC ..... B65B 2210/04; B65B 2220/14; B65B 2220/16; B65D 5/2052; B65D 5/38; B65D 5/427; B65D 21/0205; B65D 21/0209; B65D 21/0227; B65D 77/042; B65D 2577/04; B65D 2577/041; B65D 2577/043; B65D 5/4275; B65D 5/5286; B65D 21/0237
USPC ..... 53/169, 445, 467, 474, 484; 206/514; 229/120.01, 120.011, 120.012, FOR. 100, 229/FOR. 103
See application file for complete search history.

(56) References Cited

U.S. PATENT DOCUMENTS

| | | | | | |
|---|---|---|---|---|---|
| 3,820,706 | A | | 6/1974 | Gibson et al. | |
| 4,179,062 | A | * | 12/1979 | Baker | B65D 77/08 229/120.01 |
| 4,377,237 | A | * | 3/1983 | Pawlowski | B65D 5/5495 229/120.011 |
| 4,739,921 | A | * | 4/1988 | Taub | B65D 5/48024 229/120.32 |
| 4,957,202 | A | * | 9/1990 | Yoshiki et al. | B65D 21/0237 206/277 |
| 4,971,242 | A | * | 11/1990 | LaNicca | B65D 5/427 229/120.21 |
| 5,029,710 | A | | 7/1991 | Workman | |
| 5,205,403 | A | * | 4/1993 | DeBlasio | B65D 5/5495 229/120.011 |
| 5,379,886 | A | * | 1/1995 | Brauner et al. | B65D 5/5286 53/167 |
| 5,549,241 | A | * | 8/1996 | Correll | B65D 5/32 229/120.01 |
| 6,112,892 | A | * | 9/2000 | Thibaud | A24F 15/18 206/242 |
| 6,357,652 | B1 | * | 3/2002 | Evans et al. | B65D 5/427 229/120.01 |
| 6,474,539 | B1 | * | 11/2002 | Van Der Horst | B65D 5/5286 206/734 |
| 6,923,316 | B2 | * | 8/2005 | Carty et al. | B65D 5/422 206/232 |
| 7,934,636 | B2 | * | 5/2011 | Lin et al. | B65D 5/0005 229/120.01 |
| 2007/0228122 | A1 | | 10/2007 | McKenna | |
| 2008/0018095 | A1 | * | 1/2008 | Garett | B65D 5/427 206/534 |
| 2013/0000252 | A1 | * | 1/2013 | Pettersson et al. | B65B 5/024 53/396 |
| 2015/0068945 | A1 | * | 3/2015 | Baker et al. | B65D 5/427 229/120.011 |
| 2015/0175283 | A1 | | 6/2015 | Yohe | |

FOREIGN PATENT DOCUMENTS

| | | | | | |
|---|---|---|---|---|---|
| GB | 285778 | A | * | 2/1928 | B65D 5/38 |
| KR | 101588786 | B1 | * | 1/2016 | B65D 5/38 |

* cited by examiner

METHODS FOR PACKAGING A PACKAGED PRODUCT AND ONE OR MORE UNPACKAGED PRODUCTS FOR SHIPMENT

CROSS-REFERENCE TO RELATED APPLICATIONS

This application claims priority to PCT Application No. PCT/US2018/049228, filed Aug. 31, 2018 entitled "A METHOD FOR PACKAGING A PACKAGED PRODUCT AND ONE OR MORE UNPACKAGED PRODUCTS FOR SHIPMENT, A SHIPPING CONTAINER AND A METHOD FOR CREATING CUSTOMIZED PACKAGING FOR A PLURALITY OF ITEMS ON-DEMAND", which claims priority to and the benefit of U.S. Provisional Application No. 62/560,514, filed Sep. 19, 2017, and entitled OPEN-SIDED SHIPPING CONTAINER AND METHODS OF USE, the entire content of which are incorporated herein by reference.

BACKGROUND

1. Technical Field

Exemplary embodiments of the disclosure relate to packaging products and to methods for implementing packaging products. More particularly, embodiments relate to packaging products with an open side and methods for attaching such packaging products to other fully-enclosed packaging products.

2. The Relevant Technology

Distributors and sellers of products often package such products in shipping containers before sending such products to their customers. Customers often purchase or order for shipping several different products from a distributor or seller in a single transaction. In response, distributors and sellers often group all products to be shipped to a single customer together and package them in a single shipping container (e.g., in a box large enough to package the group of products). Grouping products in this manner can reduce the cost of shipping materials and other shipping expenses compared to packaging and shipping the products individually.

Distributors and sellers often sell products that they acquire from other manufacturers, wholesalers, distributors, retailers, suppliers, sellers, etc. Some such products include product packaging that is already sufficient for shipping (e.g., provides enough protection to the product for transportation) so that the product does not need to be enclosed in an additional shipping container (e.g., in a box). It is not unusual for a customer to purchase a group of products from a distributor or seller in a single transaction where one or more of the products include product packaging that is sufficient for shipping, while other products in the order require additional packaging for shipping. In such situations, distributors and sellers often package the product that is ready for shipping with all of the other products to be shipped inside of an even larger shipping container. This approach leads to inefficient use of packaging materials because it results in a package that is ready for shipping becoming re-packaged inside of another entirely separate shipping container.

Alternatively, distributors and sellers sometimes package the products that are not ready for shipping inside of an appropriately sized shipping container and ship them separately from the product that was previously made ready for shipping. This approach leads to more efficient use of packaging materials than the re-packaging method described above. However, this approach also leads to inefficient use of packaging materials because the newly packaged product (s) have to be fully enclosed within a shipping container.

SUMMARY

The present disclosure relates to a method for preparing a packaged product and one or more unpackaged products for shipping. The method includes providing a shipping container generally sized to accommodate the unpackaged product(s). The shipping container has a plurality of walls and a bottom that define an interior of the shipping container, and each of the walls has an edge that cooperates to define an open side of the shipping container. The method further includes inserting the unpackaged product(s) into the shipping container, and attaching the shipping container to the packaged product such that (a wall of) the packaged product closes or covers the open side of the shipping container.

Other embodiments of the present disclosure relate to a shipping container that includes a bottom surface and a plurality of walls extending from the bottom surface. Each wall has an edge opposite the bottom surface. The edges collectively define an open side of the shipping container. The shipping container also includes one or more flaps extending from the edges. The flaps are sized such that the open side of the shipping container remains substantially uncovered by the flaps when the flaps are folded towards the interior of the shipping container.

In yet another embodiment, a method for creating customized packaging for a plurality of items on-demand is disclosed, the plurality of items including a packaged item and one or more unpackaged items. The method includes accessing an informational store and retrieving, for each of said plurality of items, dimensional information about said plurality of items. The one or more unpackaged items are arranged into one or more model arrangements to determine if the one or more unpackaged items can be arranged to fit within two dimensions of at least one side surface of the package item. One of the model arrangements constituting an optimized model arrangement. The dimensions of the optimized model arrangement are calculated to produce a customized package template sized particularly for the one or more unpackaged items when the one or more unpackaged items are arranged and positioned consistent with the optimized model arrangement. A customized packaging template is designed based on the calculated dimensions of the optimized model arrangement. The customized package template, when erected into a package, has a bottom, a plurality of side walls, and an open side opposite the bottom.

BRIEF DESCRIPTION OF THE DRAWINGS

To further clarify the above and other advantages and features of the present disclosure, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION

Figure 1:
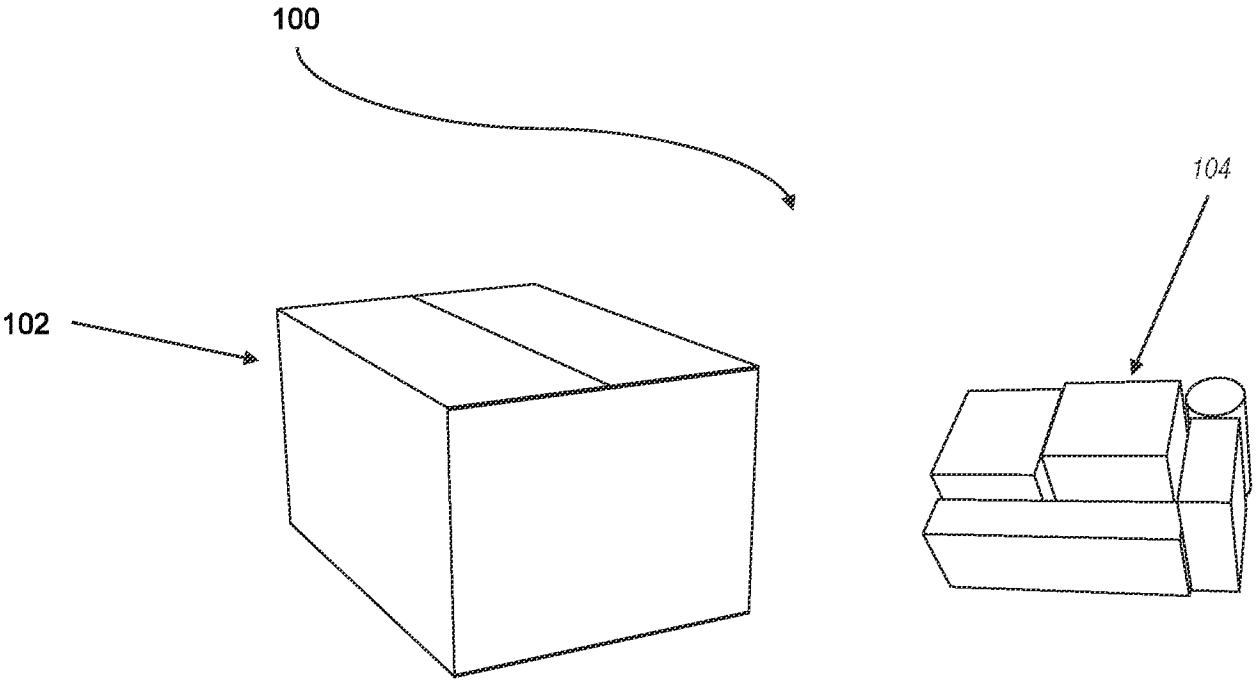
FIG. 1 illustrates a scenario involving one or more packaged products and one or more unpackaged products in which embodiments of the present disclosure may be utilized.

Before describing various embodiments of the present disclosure in detail, it is to be understood that this disclosure is not limited to the parameters of the particularly exemplified systems, methods, apparatus, products, processes, and/or kits, which may, of course, vary. Thus, while certain embodiments of the present disclosure will be described in detail, with reference to specific configurations, parameters, components, elements, etc., the descriptions are illustrative and are not to be construed as limiting the scope of the claimed invention. In addition, the terminology used herein is for the purpose of describing the embodiments, and is not necessarily intended to limit the scope of the claimed to invention.

Distributors and sellers of products often offer for sale products that include product packaging that is sufficient for shipping ("packaged products" hereafter) as well as products that require additional packaging for shipping ("unpackaged products" hereafter). For example, a printer may often be considered a packaged product because printers offered for sale by distributors and sellers are often packaged inside of a cardboard box with foam padding sufficient for shipping. On the other hand, bottles of wine, whether offered for sale as bottles alone or as bottles encased within ornamental boxes, may often be considered unpackaged products because they often require additional packaging before becoming ready for shipping. Other examples of unpackaged products include toys, tools, watches, office supplies, and the like because the packagings for such products do not offer protection sufficient for shipping.

It is not uncommon for consumers to purchase or order for shipping a combination of packaged products and unpackaged products. Existing methods for filling such purchases or orders include packaging all products to be shipped inside of a shipping container (e.g. a six-sided box) with a volume that is calculated to provide enough protection to the products for transportation while trying to maximize efficient use of packaging materials (e.g., minimizing empty space to be filled with additional packaging material). This method is preferred in many instances, particularly when the purchase or order to be filled consists solely of unpackaged products. However, when the purchase or order to be filled consists of a combination of packaged products and unpackaged products, this method leads to duplicative packaging because it results in a packaged product that is ready for shipping becoming repackaged inside of another entirely separate shipping container. Repackaging products leads to excessive use of cardboard and other packaging materials, which increases business costs for distributors and sellers. Furthermore, shipping costs often depend on the size and weight of the object(s) to be shipped. The size and weight of the object(s) to be shipped are both increased by repackaging packaged products inside of a larger shipping container and filling empty space with packaging materials, thus increasing shipping costs and further increasing business costs for distributors and sellers.

Another method for filling such purchases or orders is enclosing all unpackaged products inside of a shipping container (e.g. a six-sided box) with a volume that is calculated to provide enough protection to the products for transportation while trying to maximize efficient use of packaging materials. The shipping container may then be shipped to the consumer separately from a packaged product, or be bundled with a packaged product (e.g., using cords, straps) and then shipped to the consumer. This method, although more efficient than the former method of enclosing all products to be shipped inside of a larger shipping container, also leads to inefficient use of packaging materials because the smaller items still have to be fully enclosed in a shipping container (e.g., in the case of bundling, the sidewall area that is shared between the two shipping containers comprises extra, unnecessary layers of packaging material), and possibly be shipped separately from other products to be shipped to the same consumer.

The embodiments described herein extend to shipping containers and methods for implementing shipping containers which are configured to, for example, promote efficient use of packaging materials by eliminating unnecessary layers of packaging material to reduce duplicative packaging of products to be shipped and/or reduce excessive use of packaging materials in preparing products for shipping. The shipping containers and methods described herein, when implemented, decrease business costs for distributors and sellers by reducing unnecessary use of packaging materials and by reducing the size and weight of objects to be shipped.

FIG. 1 illustrates one exemplary scenario 100 in which embodiments described herein may be utilized. In scenario 100, a consumer has purchased or ordered for shipping from a distributor or seller one or more packaged products 102 in combination with one or more unpackaged products 104. An example of scenario 100 may be where a consumer has purchased a printer (a packaged product 102) along with a bottle of wine, a bottle of shampoo, a tool enclosed in plastic, etc. (unpackaged products 104). Traditional methods of combining these products for shipping (described above) lead to inefficient use of packaging materials and higher shipping costs. The embodiments described below serve to mitigate this inefficiency and high cost.

Figure 2A:
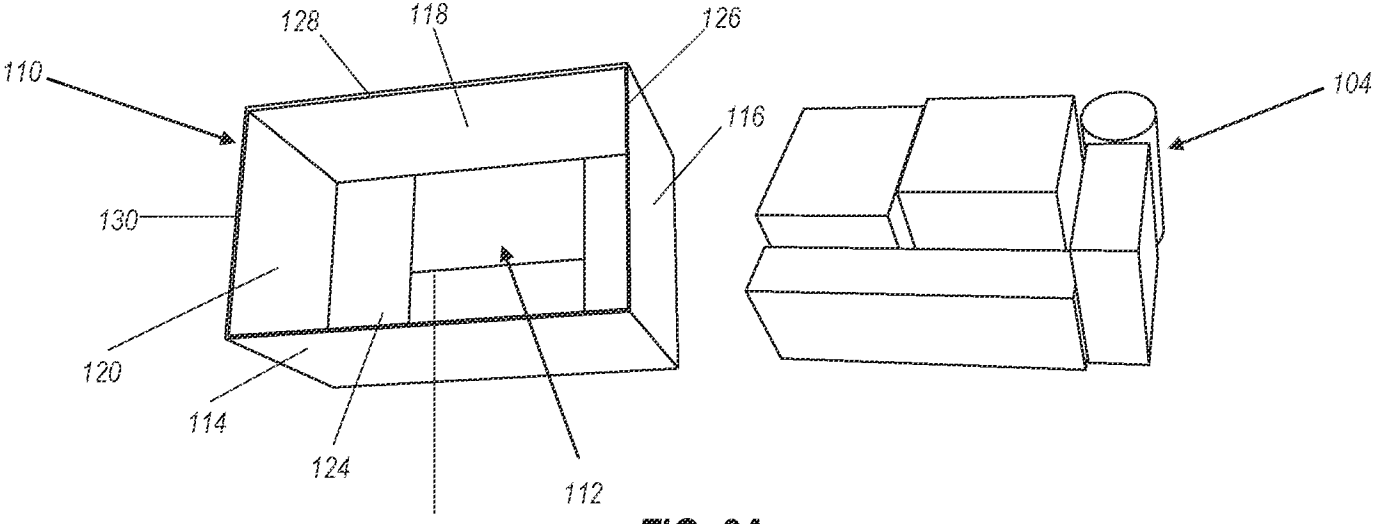
FIG. 2A illustrates an embodiment of a shipping container and unpackaged products, according to the present disclosure.
Figure 2B:
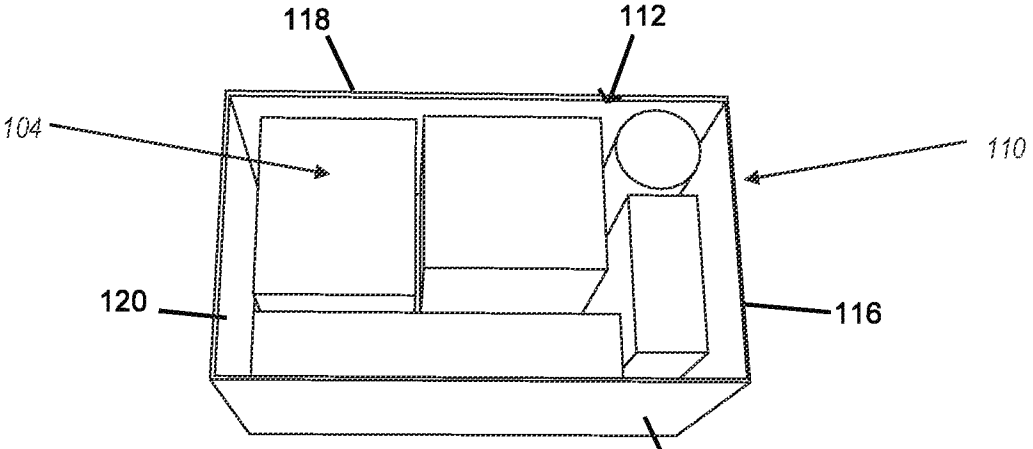
FIG. 2B illustrate the shipping container and unpackaged products of FIG. 2A with the unpackaged products disposed in the shipping container.

FIG. 2A illustrates an embodiment of a shipping container 110 that may be utilized in scenario 100 of FIG. 1. The shipping container 110 has an open side 112, which is defined by the edges of the sides that surround the open side 112. In the illustrated embodiment, the shipping container 110 has a first side 114, a second side 116, a third side 118, a fourth side 120, and a fifth side or bottom 122, all of which define the interior volume of the shipping container 110. In some cases, some of the sides can form walls. The sides 114, 116, 118, and 120 have edges 124, 126, 128, and 130, respectively, which define the open side 112. The shipping container may have a standardized interior volume (e.g., a standardized box size) or may be custom manufactured for the unpackaged to products 104 to be placed therein. FIG. 2B illustrates one possible embodiment of the shipping container 110 where the shipping container was custom manufactured to have an interior volume appropriate for efficiently housing the unpackaged products 104, and the unpackaged products 104 are placed inside of the shipping container 110.

In some embodiments, one or more of the dimensions of the shipping container 110 may be determined by a combination of the dimensions of an arrangement of the unpackaged products 104 and at least two dimensions of the packaged product 104. For instance, as shown in FIG. 2B, the lengths of the sides 114, 116, 118, 120 may be determined and manufactured to accommodate a particular arrangement of the unpackaged items 104. Additionally, for reasons discussed below, the lengths of the sides 114, 116, 118, 120 may be determined and manufactured to generally correspond to the dimensions of at least one side of the packaged product 102.

Furthermore, the heights of the sides 114, 116, 118, 120 (e.g., the distance between the edges 124, 126, 128, and 130 and the bottom 122) may be determined and manufactured to be at least as tall as the arrangement of the unpackaged items 104. In some embodiments, the heights of the sides 114, 116, 118, 120 may be taller than the arrangement of unpackaged products 104 such that the sides 114, 116, 118, 120 extend above the arrangement of unpackaged items 104. For instance, the heights of the sides 114, 116, 118, 120 may be 0.25 inches, 0.5 inches, 0.75 inches, 1.0 inches, 1.25 inches, 1.5 inches, 1.75 inches, 2.0 inches, or more taller than the arrangement of unpackaged products 104.

Figure 2C:
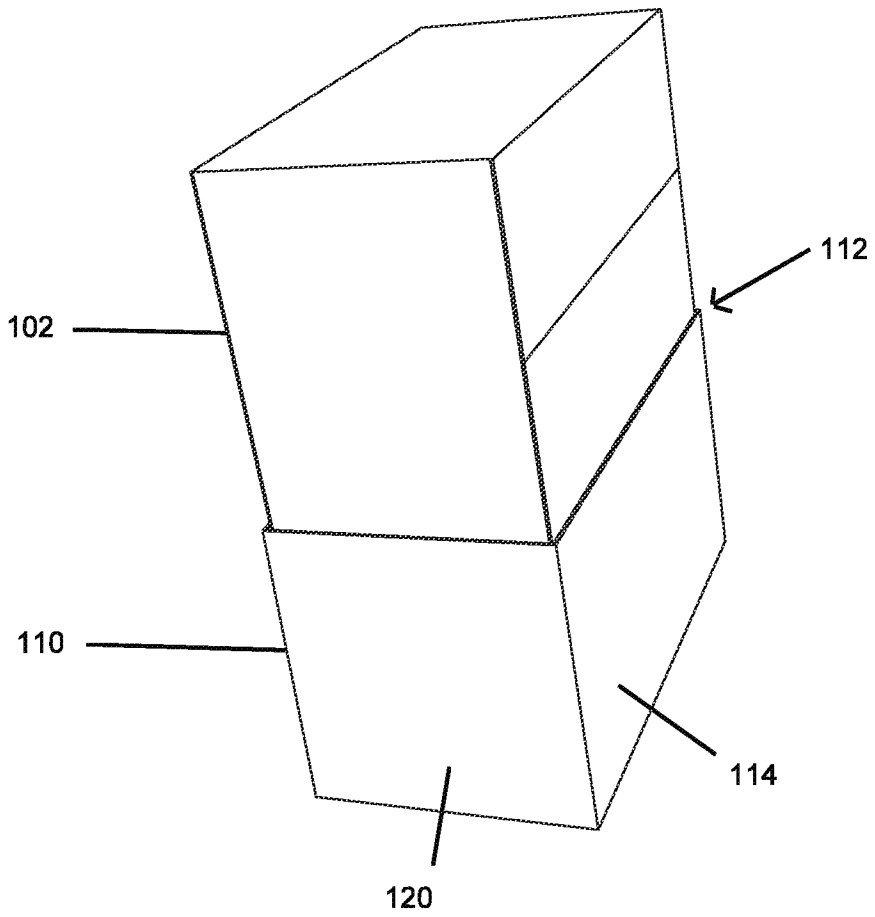
FIG. 2C illustrates a perspective view of a shipping container attached to a packaged product, according to the present disclosure.

Manufacturing the shipping container 110 so that the dimensions of the sides 114, 116, 118, 120 generally correspond to the dimensions of at least one side of the packaged product 102 and so that the sides 114, 116, 118, 120 are taller than the arrangement of unpackaged products 104 can facilitate attachment of the packaged product 102 and the shipping container 110 with the unpackaged products 104 therein. For instance, as shown in FIG. 2C, the unpackaged products 104 are within the shipping container 110 and a side of the packaged product 102 is inserted into the open side 112 of the shipping container 110. The side of the packaged product 102 that is inserted into the open side 112 of the shipping container 110 can serve as a containing wall for the unpackaged products 104 placed within the shipping container 110.

With the side of the packaged product 102 inserted into the open side 112 of the shipping container 110, the packaged product 102 and the shipping container 110 may be secured together to form a single package that may be shipped to the customer. The packaged product 102 and the shipping container 110 can be secured together in a variety of ways. For instance, one or more strips of adhesive tape may be applied across the joint formed between the packaged product 102 and the shipping container 110 (e.g., so that the adhesive tape attaches to the surfaces of both the packaged product 102 and the shipping container 104). The packaged product 102 and the shipping container 110 may also be secured together with an adhesive applied between the overlapping portions thereof (e.g., the exterior surface of the package product 102 and the interior surface of the shipping container 110 that overlap one another).

The additional height of the sides 114, 116, 118, 120 above the arrangement of unpackaged products 104 may allow the shipping container 110 to a least partially overlap the packaged product 102. The overlapping portions created by the additional height of the sides 114, 116, 118, 120 can help maintain the alignment of and the attachment between the packaged product 102 and the shipping container 104.

This arrangement of the packaged product 102 and the shipping container 104 can reduce the number of unnecessary layers of shipping material used to prepare combinations of packaged products and unpackaged products for shipping. Embodiments of this configuration allow for the shipping container 110 and the packaged product 102 to be shipped together, without enclosing them all within an even larger shipping container, thus reducing shipping costs and avoiding costs associated with excessive use of packaging materials.

As can be seen in FIG. 2C, when the packaged product 102 and the shipping container 110 (with the unpackaged products 104 therein) are attached together, the resulting package has a generally cuboid or generally rectangular box shape that is easy to stack during transportation and/or storage. Additionally, the resulting package provides sufficient protection for the products therein while minimizing the amount of packaging material used to package the products.

In some embodiments, a cubing software can be used to determine if the unpackaged products 104 can be arranged to fit within the dimensions of at least one side of the packaged product 102 or an area slightly bigger than the dimensions of at least one side of the packaged product 102. The cubing software may have the dimensions of each of the unpackaged products 104 input or stored therein. The cubing software may use the dimensions of the unpackaged products 104 to determine whether the unpackaged products 104 can be arranged to fit within the dimensions of at least one side of the packaged product 102 or an area slightly bigger than the dimensions of at least one side of the packaged product 102 (collectively referred to herein as fitting within the dimensions of at least one side of the package product). For instance, the cubing software may virtually rotate and arrange the unpackaged products 104 to determine if an arrangement, or an ideal or optimized arrangement, exists that fits within the dimensions of a least one side of the packaged product 102.

If the cubing software determines that the unpackaged products 104 can be arranged to fit within the dimensions of at least one side of the packaged product 102, the cubing software can design a shipping container with interior dimensions that can accommodate the unpackaged products 104 therein and allow for a side of the packaged product 102 to be inserted therein as shown in FIG. 2C (or to allow the shipping container to be attached to a side of the packaged product 102 as shown in FIGS. 3-5, 7A-7B and discussed below). When designing the shipping container, the cubing software can add a predetermined amount to the height of the sides of the shipping container to create the overlap between the shipping container and the packaged product 102, as discussed above.

Preparing packaged products and unpackaged products for shipment in the manner discussed herein can save significant packaging resources. For instance, rather than creating a shipping container large enough to entirely enclose both the packaged products 102 and the unpackaged products 104 or just the unpackaged products 104, the embodiments disclosed herein can reduce the amount of packaging material used by up to 80%. The significant savings can be achieved because the shipping containers do not have to fully enclose both the package products 102 and the unpackaged products 104. Moreover, the shipping containers do not even have to fully enclose the unpackaged products 104. Rather, the shipping container only surrounds five sides of the unpackaged products and uses a side of the package product to close or cover the sixth side of the unpackaged products.

The embodiments of the present disclosure can also significantly reduce shipping costs associated with shipping the packaged products 102 and the unpackaged products 104. For instance, using less packaging material to package the products as discussed above can reduce the weight of the shipped package, which can significantly reduce the associated shipping costs. Additionally, shipping one package instead of two or more packages can also significantly reduce the shipping costs.

Figure 3:
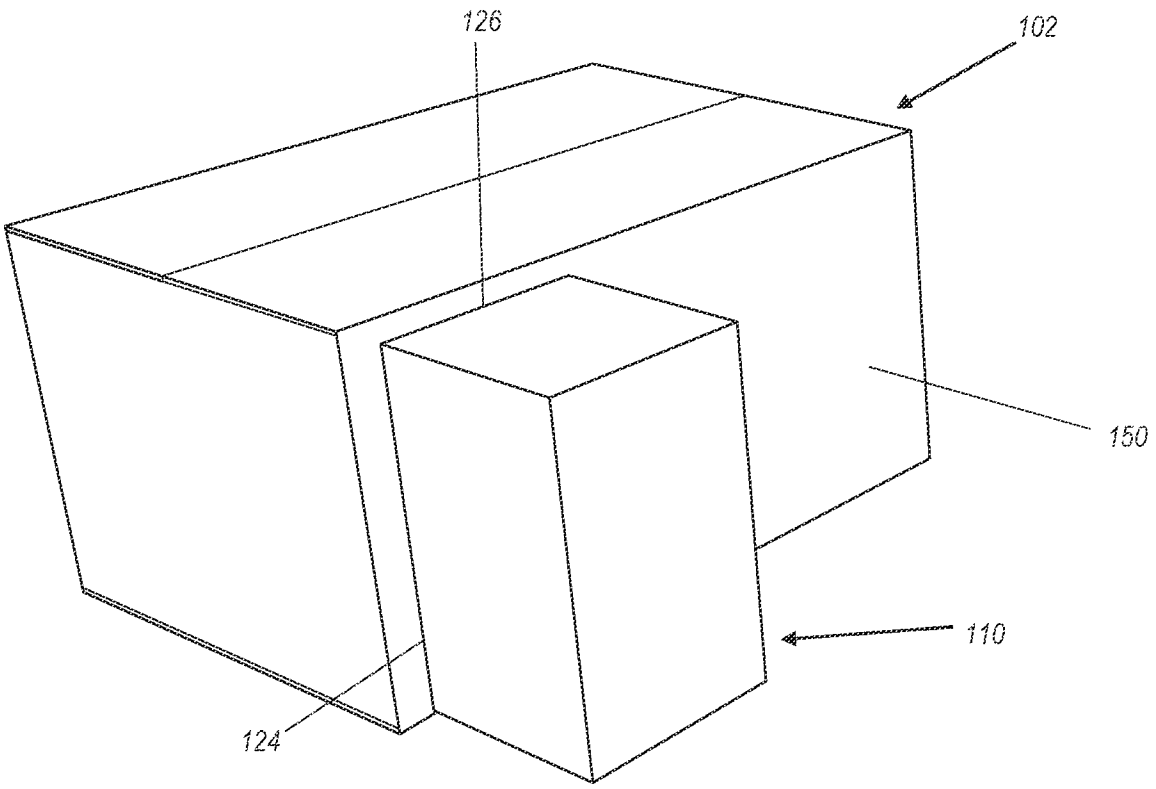
FIG. 3 illustrates another perspective view of a shipping container attached to a packaged product, according to the present disclosure.

It will be appreciated that a packaged product and a shipping container containing one or more unpackaged products may be secured to one another in a variety of ways. For instance, if the unpackaged products 104 can fit within a shipping container that is substantially smaller than a side of the packaged product 102, the unpackaged products 104 may be packaged in a substantially smaller shipping container, which can then be attached to a side of the packaged product 102. For instance, FIG. 3 illustrates a configuration for a shipping container 110 that is substantially smaller than any side of the package product 102. In the illustrated configuration, the unpackaged products 104 are within the shipping container 110, and the edges 124, 126, 128, and 130 that define the open side 112 of the shipping container 110 are affixed to a face 150 of the packaged product 102. Adhesives (e.g., water-based, solvent-based, or hot-melt adhesives) may be used to affix edges 124, 126, 128, and 130 to the face 150 of the packaged product 102.

The edges 124, 126, 128, and 130 may become affixed to any face of the packaged product 102. The edges 124, 126, 128, and 130 that become affixed to the face 150 of the packaged product 102 may take any position on the face 150, as long as at least a portion of each edge 124, 126, 128, and 130 is attached to the face 150 of the packaged product 102 or an edge of the face 150. Embodiments of this configuration allow the face 150 of the packaged product 102 to which the shipping container 110 is attached to serve as a containing wall for both the packaged product 102 and the unpackaged products 104 placed within the shipping container 110. This reduces the number of unnecessary layers of shipping material used to prepare combinations of packaged products and unpackaged products for shipping. Embodiments of this configuration also allow for the shipping container 110 and the packaged product 102 to be shipped together, without enclosing them all within an even larger shipping container, thus reducing shipping costs and avoiding costs associated with excessive use of packaging materials.

Figure 4:
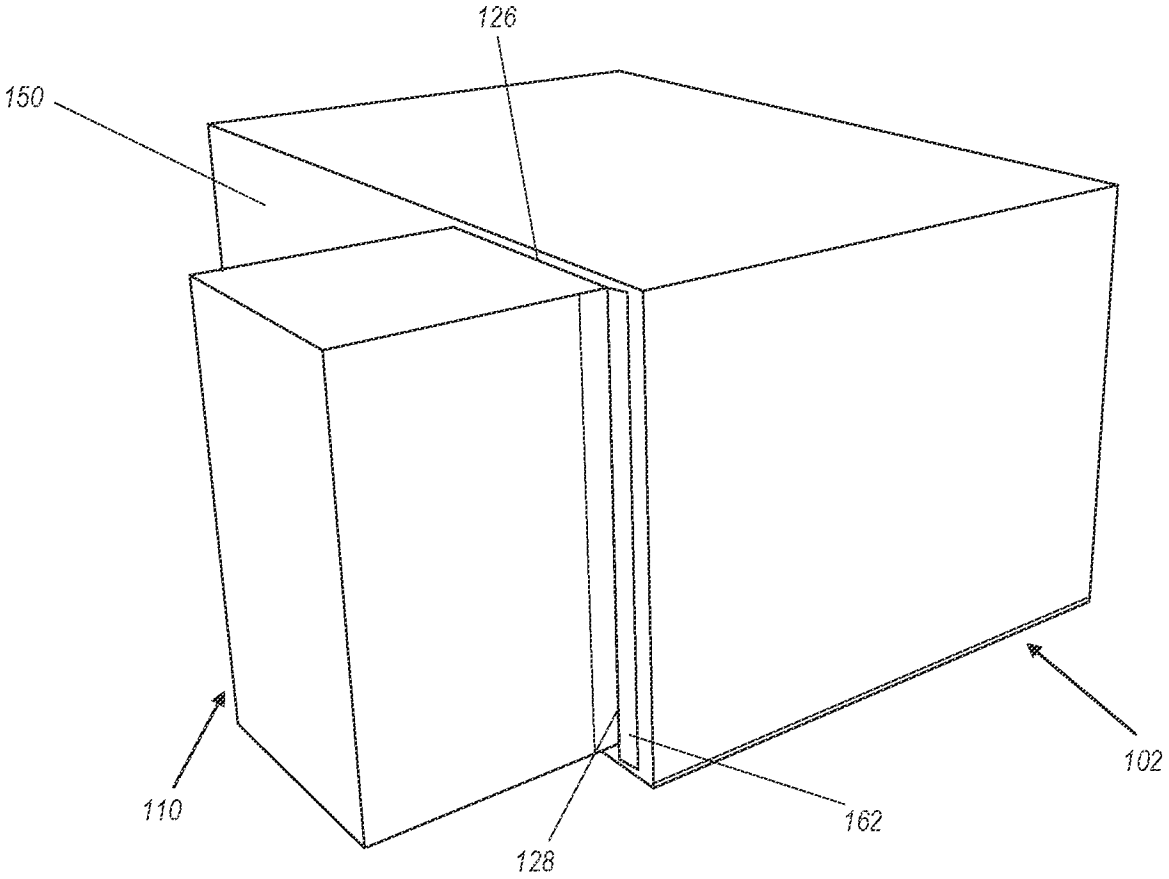
FIG. 4 illustrates another perspective view of a shipping container attached to a packaged product, according to the present disclosure.

In addition to the adhesives mentioned above, the edges of the shipping container 110 may be affixed to the face 150 (or edges thereof) of the packaged product 102 in a variety of ways. For example, FIG. 4 illustrates another implementation for affixing the shipping container 110 to the packaged product 102. As illustrated, strip(s) of adhesive tape 162 is placed along one or more of edges 124, 126, 128, and 130 to affix edges 124, 126, 128, and 130 to the face 150 of the packaged product 102.

Figure 5:
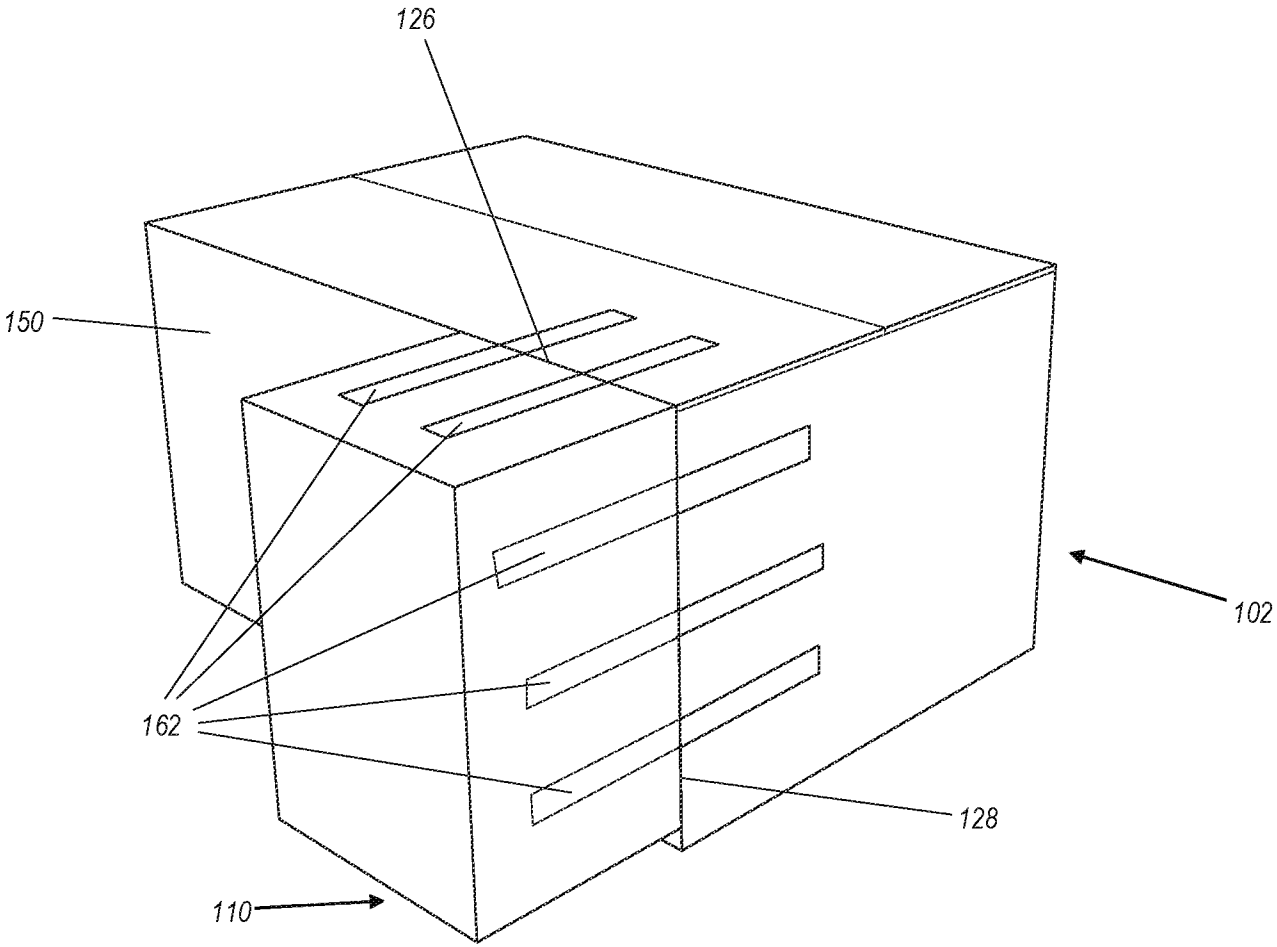
FIG. 5 illustrates another perspective view of a shipping container attached to a packaged product, according to the present disclosure.

FIG. 5 illustrates an additional implementation for affixing a shipping container 110 to a packaged product 102. Edges 126 and 128 of the shipping container 110 are substantially aligned with two of the edges of the face 150 of the packaged product 102. Other embodiments may include configurations where any number of the edges of the shipping container 110 that define the open side 112 are substantially aligned with any number of the edges of the face of the packaged product 102 (e.g., zero, one, two, . . . ). Additionally, in the illustrated embodiment, strips of adhesive tape 162 are placed to extend across adjacent faces so as to span the interface between the shipping container 110 and the packaged product 102. In some instances, the adjacent faces are generally parallel and in other instances the faces are nonparallel.

Figure 6:
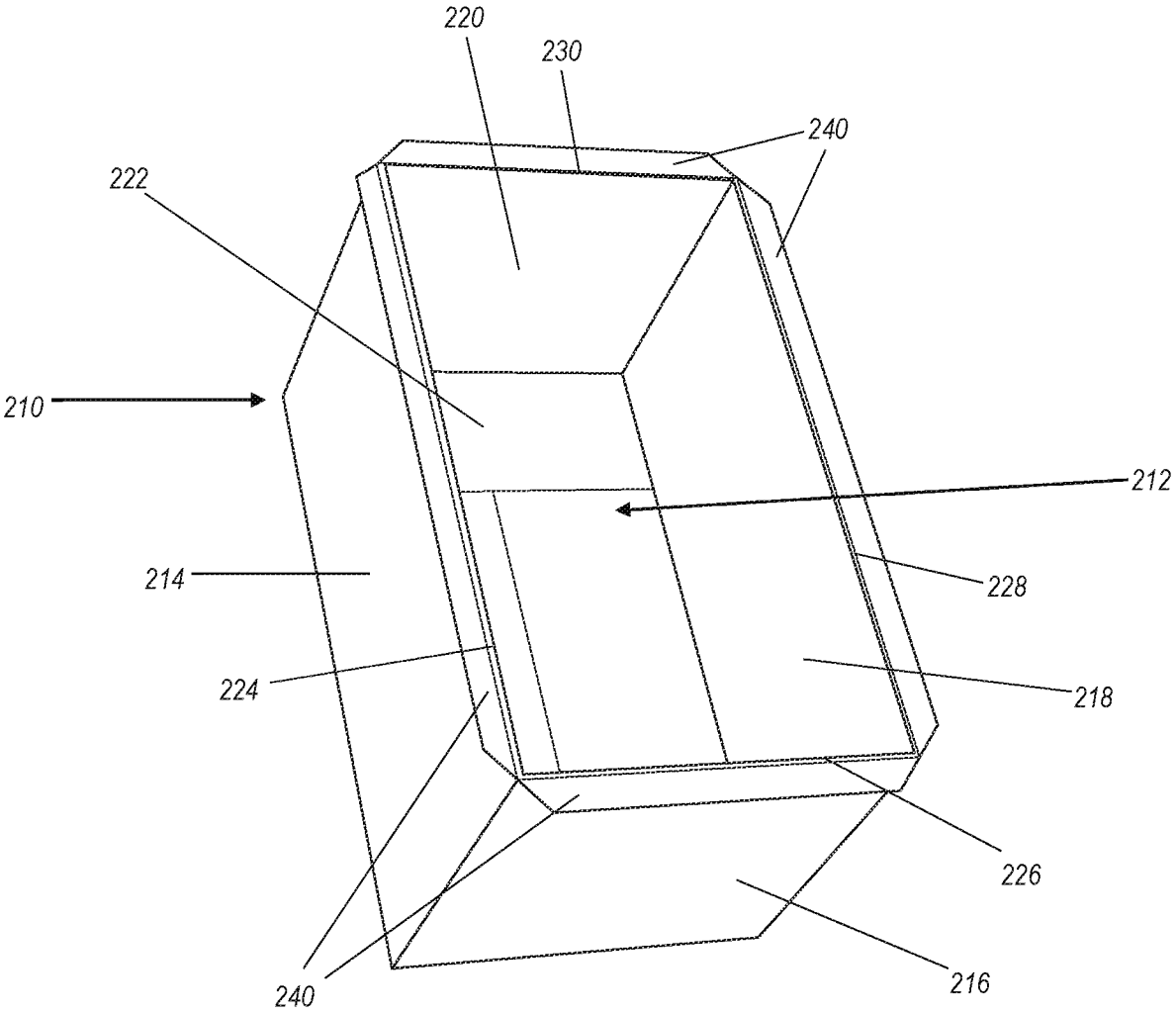
FIG. 6 illustrates a perspective view of another embodiment of a shipping container, according to the present disclosure.

FIG. 6 illustrates possible embodiments of a shipping container 210, similar to the shipping container 110 of FIG. 2A. In FIG. 6, the shipping container 210 has five sides 214, 216, 218, 220, and 222. Sides 214, 216, 218, and 220 have edges 224, 226, 228, and 230, which define the open side 212. As illustrated, flaps 240 extend from each of edges 224, 226, 228 and 230. In some embodiments, the flaps 240 are formed by folding portions of the packaging material that constitute sides 214, 216, 218, and 220 at edges 224, 226, 228, and 230. In other embodiments, the flaps 240 may be formed by attaching additional packaging material to the edges of the sides that define the open side 212. The flaps 240 may extend from the sides to which they are attached and may be directed outwards as illustrated in FIG. 6 and may run along at least a portion of the length of the edge to which they are attached or extend from.

Some embodiments of the shipping container 210 may include one flap 240 for each edge that defines the open side 212, or may have fewer or more flaps 240 than edges that define the open side 212. For example, a shipping container 210 may have one, two, three, or more than four flaps attached to its edges. Embodiments of the shipping container 210 may contain any combination of edges with or without flaps 240 extending from or attached to them.

The flaps 240 may be specifically designed to facilitate attachment to a packaged product 202. For example, a flap may extend two inches, three inches, four inches, five inches, etc. from the edge to which it is attached. In some embodiments, the flaps 240 of a shipping container 210 may be designed to have a combined surface area (i.e., the combined surface area of one major surface for each flap) that does not enclose the open side 212. For instance, the combined surface area of the flaps 240 of a shipping container 210 may be less than 25%, 20%, 15%, 10%, or 5% of the area of the open side 212.

Figure 7B:
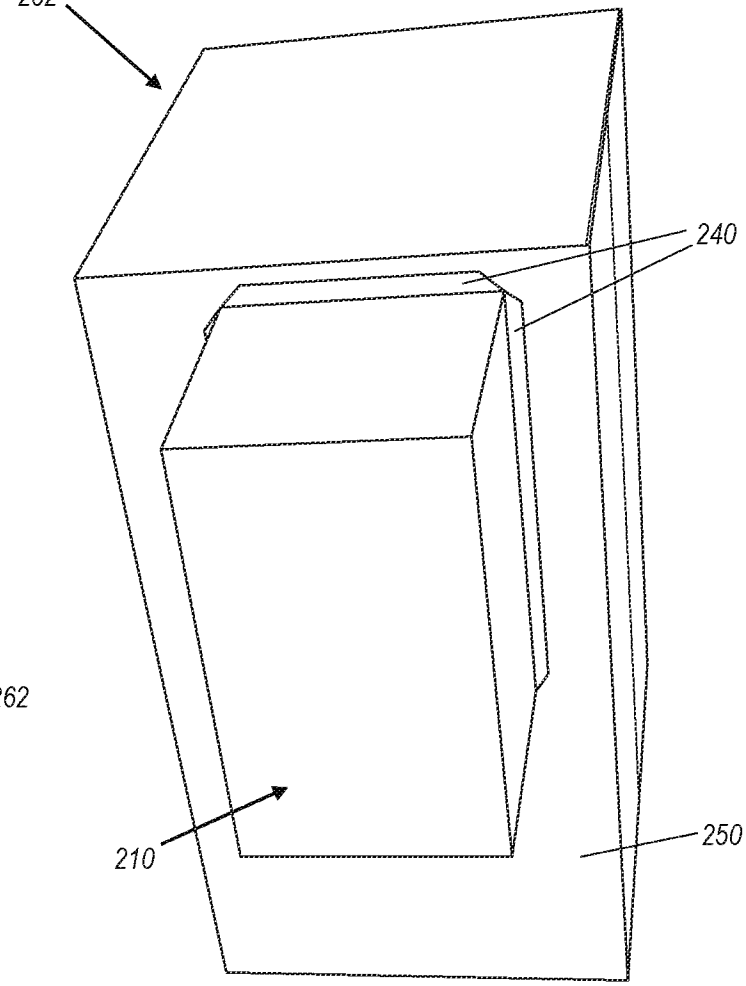
FIGS. 7A and 7B illustrate perspective views of shipping containers attached to a packaged product in various configurations, according to the present disclosure.
Figure 7A:
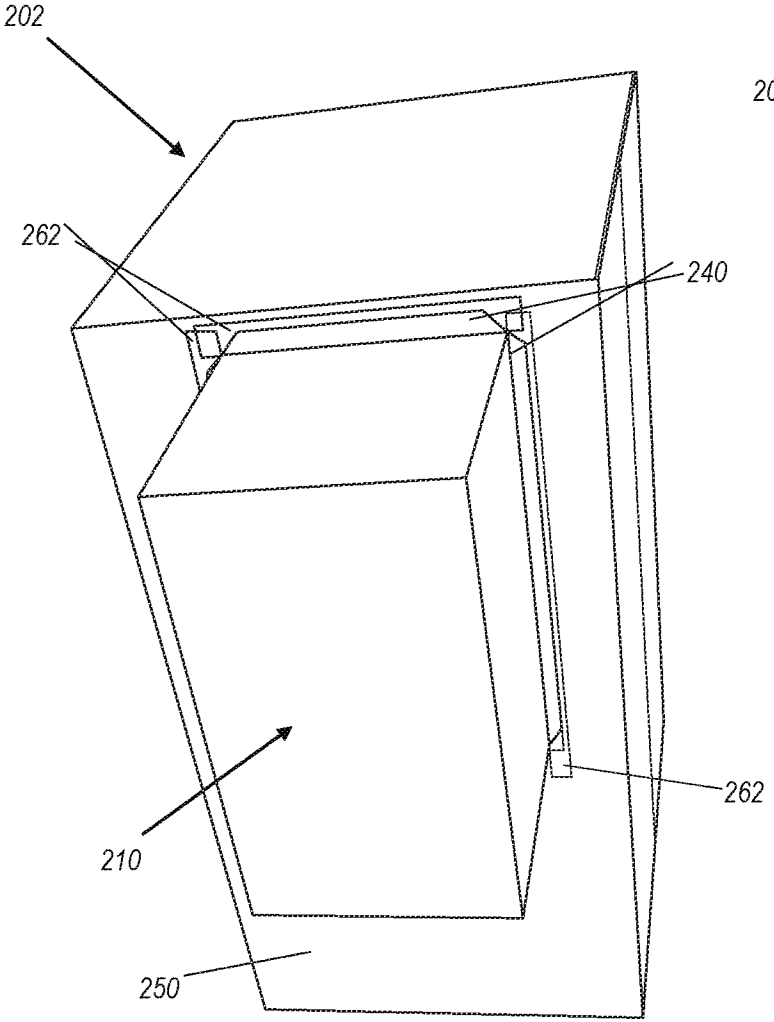

The flaps described in FIG. 6 may be used to facilitate attachment to a packaged product. For example, in FIGS. 7A and 7B, strips of adhesive tape 262 are applied to the flaps 240 to affix the shipping container 210 to the face 250 of the packaged product 202. In some configurations, one or more of the flaps may extend onto a parallel face of the packaged product. For example, if one of the edges of the shipping container 210 were substantially aligned with an edge of the face of the packaged product, the flap may extend onto a parallel face of the packaged product. In FIG. 7B, other adhesives (e.g., water-based, solvent-based, or hot-melt adhesives) are applied to the flaps 240 to affix the shipping container 210 to the face 250 of the packaged product 202.

Figure 8:
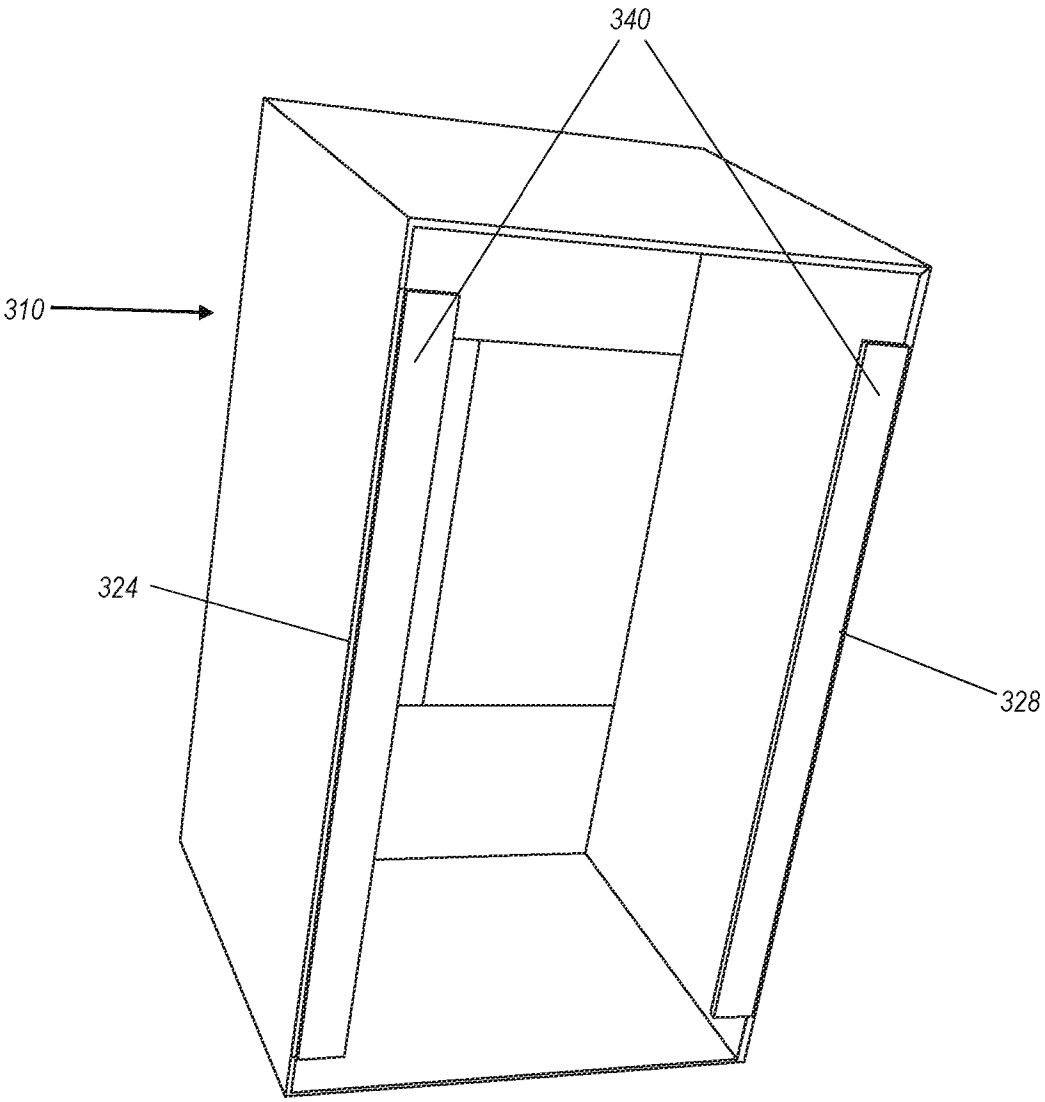
FIG. 8 illustrates a perspective view of another embodiment of a shipping container, according to the present disclosure.

FIG. 8 illustrates an embodiment of a shipping container 310 which is similar to the shipping container of FIG. 6, but with a different configuration of flaps 340. In FIG. 8, the shipping container 310 has two flaps 340, which extend along only a portion of the length of the edges 324 and 328 to which they are attached. Furthermore, the flaps 340 are directed inward. Similar to the outward-directed flaps of FIG. 6, the inward-directed flaps 340 may be used to facilitate attachment to a packaged product. For example, an adhesive could be applied to the interface between the flaps 340 and a packaged product to attach the shipping container 310 to the packaged product. As with the embodiment of FIG. 6, the number, size, and arrangement of flaps 340 may vary from one embodiment to another.

The foregoing description pertains to open-sided shipping containers configured for and/or including attachment features that facilitate attachment to a packaged product. Although the foregoing description has primarily concerned shipping containers with a rectangular box geometry, other embodiments may include shipping containers with other geometries. For example, a shipping container may have a pyramidal geometry.

The foregoing description also discloses strips of adhesive tape and other adhesives as means for attaching open-sided shipping containers to packaged products, but the scope of the disclosure is not limited to such means for attaching. Furthermore, the foregoing description describes flaps which could be directed inward or outward and extend along a perpendicular or parallel face of a packaged product. The description shall not be construed as limiting the types of flap configurations that could be implemented into the disclosed shipping containers. For example, flaps may vary in length and size, depending on the size and weight of the products to be shipped, or other considerations.

Elements described in relation to any embodiment depicted and/or described herein may be substituted for or combined with elements described in relation to any other embodiment depicted and/or described herein. For example, a shipping container may include two edges with flaps and two edges without flaps or two edges with inwardly directed flaps and two edges with outwardly directed flaps, and may be affixed to a face of a packaged product by a combination of adhesive tape and other adhesives.

Reference has been made to the drawings to describe various aspects of exemplary embodiments of the invention. It is understood that the drawings are diagrammatic and schematic representations of such exemplary embodiments, and are not limiting of the present invention, nor are any particular elements to be considered essential for all embodiments or that elements be assembled or manufactured in any particular order or manner. No inference should therefore be drawn from the drawings as to the necessity of any element. In the foregoing description, numerous specific details are set forth in order to provide a thorough understanding of the present invention. It will be obvious, however, to one of ordinary skill in the art that the present invention may be practiced without these specific details. In other cases, well known aspects of packaging materials, packaging methods and related devices and methods, general manufacturing techniques, and the like are not described in detail herein in order to avoid unnecessarily obscuring the novel aspects of the present invention.

FIGS. 1 through 8 and the foregoing discussion are intended to provide a brief general description of exemplary devices in which embodiments of the invention may be implemented. While embodiments of shipping containers and methods are described above, this is but one single exemplary application for the present disclosure, and disclosed embodiments may be implemented in other applications, both within the product distribution field and in other technical fields.

What is claimed:

1. A method of packaging a packaged product and one or more unpackaged products for shipment, the method comprising:

providing a shipping container generally sized to accommodate the one or more unpackaged products, the shipping container having a plurality of walls and a bottom that define an interior of the shipping container, the interior having dimensions that generally correspond to dimensions of the packaged product, each of the plurality of walls having an edge that cooperates to define an open side of the shipping container;

inserting the one or more unpackaged products into the shipping container;

inserting a portion of the packaged product into the interior of the shipping container through the open side thereof such that the plurality of walls of the shipping container partially overlap the packaged product, the packaged product extends partially out of the shipping container, and the packaged product closes or covers the open side of the shipping container; and attaching the shipping container to the packaged product with the packaged product extending partially out of the shipping container.

2. The method of claim 1, wherein providing the shipping container comprises making a custom-sized container for the one or more unpackaged products.

3. The method of claim 2, wherein making a custom-sized container for the one or more unpackaged products comprises making interior dimensions of the open side of the shipping container generally correspond to dimensions of at least one side of the packaged product.

4. The method of claim 2, wherein making a custom-sized container for the one or more unpackaged products comprises making a height of the plurality of walls a predetermined amount taller than the one or more unpackaged products such that the plurality of walls of the shipping container and the packaged product partially overlap one another when the portion of the packaged product is inserted into the shipping container.

5. The method of claim 1, wherein attaching the shipping container to the packaged product comprises using a wall of the packaged product as a retaining wall to hold the unpackaged products in the shipping container.

6. The method of claim 1, wherein attaching the shipping container to the packaged product comprises applying an adhesive between at least portions of the edges of the plurality of walls and the packaged product.

7. The method of claim 1, wherein attaching the shipping container to the packaged product comprises applying one or more adhesive strips across an interface between the open side of the shipping container and the packaged product.

8. The method of claim 1, wherein the shipping container comprises one or more flaps extending from one or more of the edges of the plurality of walls.

9. The method of claim 8, wherein attaching the shipping container to the packaged product comprised attaching the one or more flaps to the packaged product.

10. The method of claim 9, wherein attaching the shipping container to the packaged product comprises applying an adhesive between at least portions of the one or more flaps and the packaged product.

11. The method of claim 9, wherein attaching the shipping container to the packaged product comprises applying one or more adhesive strips across the one or more flaps and the packaged product.

12. The method of claim 8, further comprising folding the one or more flaps outward and away from the interior of the shipping container.

13. A method of packaging a packaged product and one or more unpackaged products for shipment, the method comprising:

determining two dimensions of at least one side of the packaged product;

selecting an arrangement of the one or more unpackaged products, the selected arrangement of the one or more unpackaged products having length, width, and height dimensions, the length and width dimensions being equal to or less than the two dimensions of the at least one side of the packaged product;

providing a shipping container configured to accommodate the one or more unpackaged products therein, the shipping container having a plurality of walls, a bottom, and an open side that define an interior of the shipping container, the interior of the shipping container having length, width, and height dimensions, the length and width dimensions of the interior generally corresponding to the two dimensions of the at least one side of the packaged product and the height dimension being greater than the height dimension of the selected arrangement of the one or more unpackaged products;

inserting the one or more unpackaged products into the shipping container in the selected arrangement; and inserting a portion of the packaged product into the shipping container through the open side thereof such that the packaged product closes or covers the open side of the shipping container and extends partially out of the shipping container, the portion of the height dimension of the interior of the shipping container that is greater than the height dimension of the selected arrangement of the one or more unpackaged products enabling the plurality of walls to partially overlap the packaged product.

14. The method of claim 13, wherein the at least one side of the packaged product acts as a retaining wall to hold the unpackaged products in the shipping container.

15. The method of claim 13, further comprising attaching the shipping container to the packaged product.

16. The method of claim 15, wherein attaching the shipping container to the packaged product comprises applying an adhesive between at least portions of the edges of the plurality of walls and the packaged product.

17. The method of claim 15, wherein attaching the shipping container to the packaged product comprises applying one or more adhesive strips across an interface between the open side of the shipping container and the packaged product.

* * * * *